United States Patent [19]

Brown

[11] 4,002,874

[45] Jan. 11, 1977

[54] DOUBLE-THROW ROCKER SWITCH WITH SELECTIVE LOCKOUT MEANS

[75] Inventor: Harry W. Brown, Big Bend, Wis.

[73] Assignee: Cutler-Hammer, Inc., Milwaukee, Wis.

[22] Filed: Mar. 19, 1975

[21] Appl. No.: 559,673

[52] U.S. Cl. ..... 200/321; 200/157

[51] Int. Cl.[2] ..... H01H 21/50

[58] Field of Search ..... 200/321, 323, 157

[56] References Cited

UNITED STATES PATENTS 3,329,789 7/1967 Sahrbacker ..... 200/321 X

*Primary Examiner*—Herman J. Hohauser

*Attorney, Agent, or Firm*—Hugh R. Rather; William A. Autio; Michael E. Taken

[57] ABSTRACT

A double-throw rocker switch having a selectively shiftable lockout member which when shifted to one lateral position allows depression of only one end of the rocker button and when shifted to the opposite lateral position allows depression of only the other end of the rocker button. This lockout member is secured to the center of a mounting shaft having pushbuttons at its ends and this shaft is mounted to the switch housing for limited lateral sliding movement sufficient to shift the lockout member, this shaft serving also as a pivot pin for the rocker button and the contact actuator. This selective lockout may be used in a tool reversing application where plugging of the motor could be hazardous.

10 Claims, 6 Drawing Figures

DOUBLE-THROW ROCKER SWITCH WITH SELECTIVE LOCKOUT MEANS

BACKGROUND OF THE INVENTION

Switches with selective lockout means have been known heretofore. However, these prior switches have generally been of the slide button or toggle lever type wherein the selective lockout structure has been specifically designed for cooperation with a slide button switch actuator or with the shank of a pivoted handle, i.e., toggle lever, and therefore has not been adaptable to other types of switch actuators. While these prior switches with selective lockout means haven been useful for their intended purposes, this invention relates to rocker switches with selective lockout.

SUMMARY OF THE INVENTION

An object of the invention is to provide an improved rocker switch.

A more specific object of the invention is to provide a double-throw rocker switch with improved selective lockout means.

Another specific object of the invention is to provide a double-throw rocker switch with improved selective lockout means that is readily shiftable by lateral push-buttons.

Another specific object of the invention is to provide an improved double-throw rocker switch incorporation selective lockout means that is simple in construction and assembly.

Other objects and advantages of the invention will hereinafter appear.

DESCRIPTION OF THE PREFERRED EMBODIMENT

Figure 1:
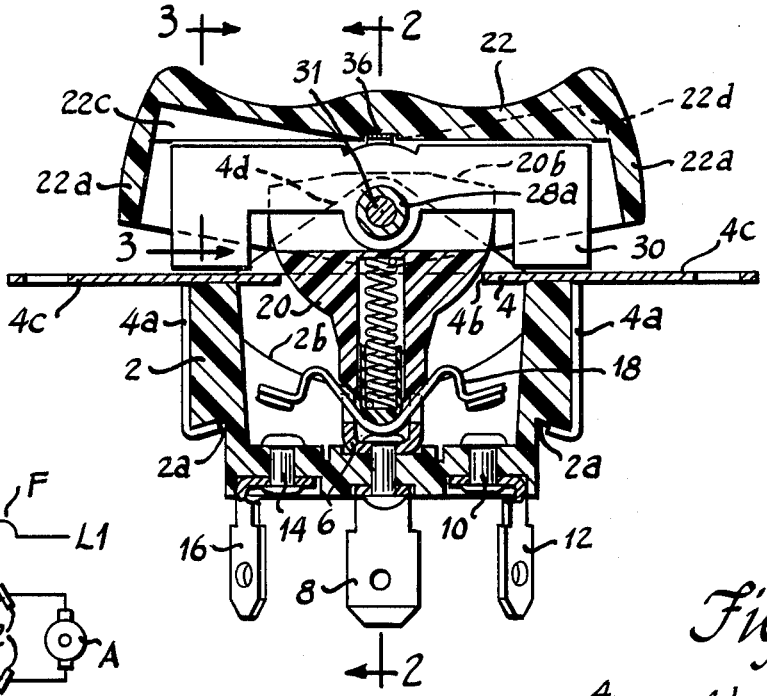
FIG. 1 is an enlarged cross-sectional view of a double-pole double-throw rocker switch with selective lockout means taken along line 1—1 of FIG. 2.
Figure 2:
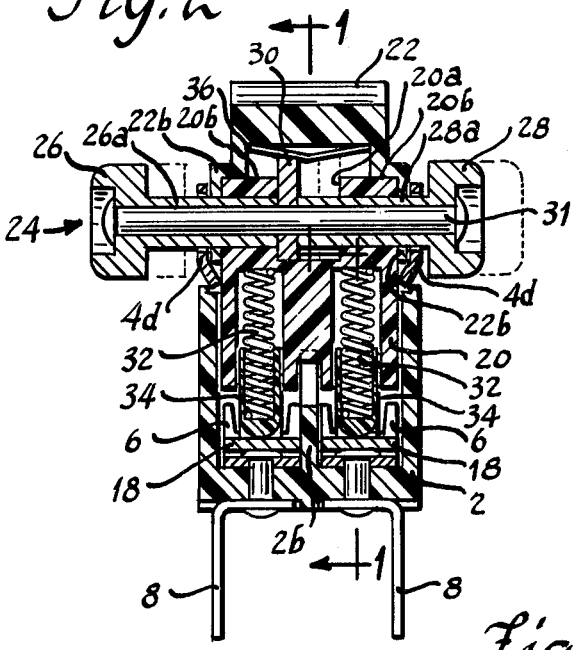
FIG. 2 is a cross-sectional view of the rocker switch with selective lockout means taken along line 2—2 of FIG. 1.

Referring to FIGS. 1 and 2, there is shown a double-throw rocker switch with selective lockout means constructed in accordance with the invention. This switch is of the double-pole type. As shown therein, this switch is provided with a housing comprising an insulating base 2 and a metal cover or frame 4 clinched to the base. This metal frame serves to support the switch operator and selective lockout means on top of the base and also serves to mount the switch to a panel as hereinafter decribed.

Insulating base 2 provides the switch compartment and supports the contacts and also the terminals whereby the switch is connected to a power supply line and load. For this purpose, base 2 is a generally rectangular cup-shaped molded member open at the top and having six holes at the bottom for receiving stationary contact and terminal rivets. Thus, there are provided a pair of central holes through which rivets extend to secure and elecctrically connect a pair of line contacts 6 within the base to a pair of respective external terminals 8 below the bottom of the base as shown in FIG. 2. In a similar manner, there are provided a pair or right holes through which rivets extend to secure and electrically connect a pair of forward contacts 10 within the base to a pair of respective external terminals 12 below the bottom of the base, one of these contact-rivet and terminal assemblies being shown in FIG. 1 wherein the contact is an integral head of the rivet. And in a similar manner, there are provided a pair of left holes through which similar rivets extend to secure and electrically connect a pair of reverse contacts 14 within the base to a pair or respective external terminals 16 below the base, one of these contact-rivet and terminal assemblies being shown in FIG. 1 wherein the contact is an integral head of the rivet.

Base 2 is provided with undercut ends **2*a* as shown in FIG. 1 to enable the legs of the frame to be clinched thereto by bending the lower ends of the legs thereunder. A dividing wall 2*b*** integral with the base separates the two poles of the switch.

Line contacts 6 are formed as a cradle for retaining the movable contacts 18 for rocking movement thereon, these rocking movable contacts each having opposite lateral projections that are retained between the two pairs of upstanding ears shown in FIG. 2 to allow rocking on but no slippage of the movable contacts off the stationary contacts.

Forward contacts 10 are in the form of buttons or rivet heads and may be integral with the associated shanks and are arranged to be contacted by the contact buttons secured to the ends of the movable contacts. Reverse contacts 14 are similar to forward contacts 10, forward and reverse referring to the direction of load energization or motor operation as hereinafter described in connection with FIG. 6.

Figure 6:
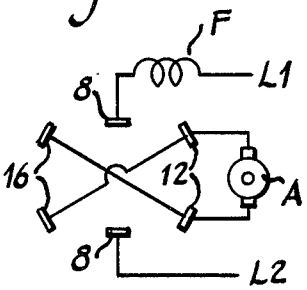
FIG. 6 is a schematic diagram showing how the terminals of the double-pole double-throw switch of FIG. 1 may be connected to a power line and motor load for reversing purposes.

Movable contacts 18 are generally V-shaped at the center where they are seated in their associated line contacts, line referring to the power lines to which these contacts are connected as shown in FIG. 6. This V-shape establishes a center off position for the movable contacts. The opposite ends of these movable contacts are bent down and out to afford proper engagement and the proper contact gap in the open position.

Figure 4:
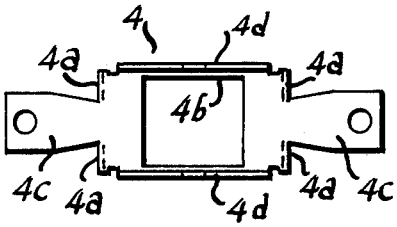
FIG. 4 is a top view of the frame used in the switch of FIG. 1 but on a smaller scale.
Figure 5:
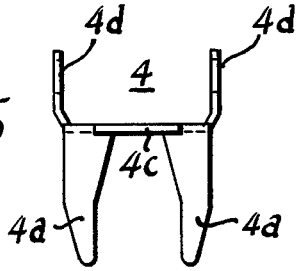
FIG. 5 is an end view of the switch frame of FIG. 4.

Frame 4 is shown most clearly in FIGS. 1, 4 and 5. As shown therein, this frame is formed from a sheet of metal such as steel and is provided with two pairs of downwardly bent legs **4*a*, one pair at each end, whereby the frame is secured to the base. As shown in FIG. 1, the two pairs of legs hug the end walls of the base and the lower tips of these legs are clinched below undercut portions 2*a*** to secure the frame over the base.

This frame is provided with a rectangular hole **4*b* in the middle as shown in FIGS. 1 and 4 affording access for the actuator into the switch compartment. This frame is also provided with lateral brackets 4*c* extending in opposite directions, each having a hole for a mounting screw, whereby the switch is mounted to a panel or support. The frame is further provided with means for mounting a switch operator and the aforementioned selective lockout means. This mounting means comprises two bent-up generally triangular brackets 4***d* having aligned holes therethrough as shown in FIGS. 4 and 5 and in broken lines in FIG. 1. These triangular brackets are bent up at the opposite sides of the switch so that they are spaced apart affording space therebetween for pivotally supporting the switch operator hereinafter described.

The switch operator comprises two molded parts that fit together including a switch actuator 20 and a rocker 22 that are suppported by mounting shaft 24 of the selective lockout means for rocking movement in unison on the aforementioned bent-up brackets of the frame.

This switch actuator has an upper, generally semi-circular portion with a hole therethrough large enough to receive the tubular stems 26*a* and 28*a* of a pair of oppositely aligned pushbottons 26 and 28 that form a part of mounting shaft 24. Lockout member 30 which has a hole only large enough to receive rivet 31 is gripped between the inner ends of stems 26*a* and 28*a* when the parts are clamped together by this rivet. As will be apparent, these stems first pass through the holes in the upstanding brackets of the frame to mount the parts to the frame. This switch actuator also has a downwardly projecting narrower portion having two holes extending upwardly thereinto, as shown in FIGS. 1 and 2, for accommodating helical compression springs 32 and plungers 34. These spring-biased plungers bear down against the movable rocking contacts and slide therealong to rock them into engagement with the stationary contacts when the switch is operated.

This switch actuator also has a groove 20*a* along its upper semi-circular portion where the shaft 24 passes through as shown in FIG. 2 to provide clearance for shifting selective lockout member 30 and to limit the extend of such shifting movement for proper positioning.

This selective lockout member 30 is a flat, generally low, inverted U-shaped member made of steel or the like and having a hole through its midportion large enough to receive rivet 31. Thus, this lockout member will be clamped between the inner ends of the tubular stems of the pushbottons when the rivet is riveted in place. The short depending legs of this lockout member rest on the upper surface of the frame. As a result, when one pushbutton is pressed, the lockout member is shifted laterally to its limit of movement. When the other pushbutoon is next pressed, the lockout member is shifted laterally back to its limit of movement in the opposite direction.

The upper edges 20*b* on each side of groove 20*a* of the actuator fit snugly against complementary recesses in the rocker as shown in broken lines in FIG. 1 and in FIG. 2 to lock the actuator rigidly to the rocker when the shaft 24 has been assembled thereby to enable the actuator to be positively operated by the rocker with no lost motion therebetween.

This rocker 22 is provided with a cavity thereunder open at the bottom and defined by end skirts 22*a* shown in FIG. 1 that are continuous with side skirts 22*b* shown in FIG. 2. The ceiling of this cavity within the rocker is laterally stepped in one direction to the left of the pivot shaft 24 and is laterally stepped in the other direction to the right of the shaft to provide clearance 22*c* and 22*d*, respectively for the lockout member in respectively alternate positions thereof. Since the rocker is pivoted at its middle, each step tapers in an increasing manner from the center toward the end of the rocker. As shown in FIG. 1, the clearance is forwardly on the left side of the pivot shaft and is rearwardly on the right side of the pivot shaft. The side skirts 22*b* have aligned holes as shown in FIG. 2 through which the pivot shaft extends. A lateral groove is provided at the center of the ceiling within the rocker cavity for retaining a leaf spring 36 shown most clearly in FIG. 2. This leaf spring is a detenting means and for this purpose is bent down at its center to provide resilient interference for movement of the lockout member. Thus, the spring retains the lockout member in one position or the other and the lockout member must be snapped over the high point on this spring when the lockout member is shifted.

Figure 3:
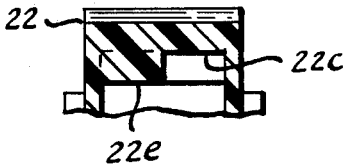
FIG. 3 is a cross-sectional view of the rocker button taken along line 3—3 of FIG. 1.

It will be apparent from the foregoing that when pushbutton 28 has been depressed as shown in FIG. 2, the right end of the rocker in FIG. 1 can be depressed to close the left-hand double-pole contacts. This causes terminals 8 to be connected to corresponding ones of terminals 16 in FIG. 6 whereby motor armature A will be energized in one direction with respect to the motor field F energization. As a result, the motor runs in the reverse direction. The left end of the rocker cannot be depressed because high point 22*e* shown in FIG. 3 abuts the lockout member thereby preventing the motor from being quickly energized in the other direction. In this circuit the power can be either A.C. or D.C.

In a similar manner, when pushbutton 26 in FIG. 2 is depressed, the left end of the rocker in FIG. 1 can now be depressed to close the right-hand double-pole contacts. This causes terminals 8 to be connected to corresponding ones of terminals 12 in FIG. 6 whereby the motor armature will be energized in the opposite direction with respect to the motor field energization. As a result, the motor runs in the forward direction. The right end of the rocker now cannot be depressed because the high point therein abuts the lockout member thereby preventing the motor from being reversed quickly without first shifting the lockout member. This avoids inadvertent plugging of the motor which might create a hazard in certain applications.

While the apparatus hereinbefore described is effectively adapted to fulfill the objects stated, it is to be understood that the invention is not intended to be confined to the particular preferred embodiment of double-throw rocker switch with selective lockout means disclosed, inasmuch as it is susceptible of various modifications without departing from the scope of the appended claims.

I claim:

1. A double-throw rocker switch with selective lockout means comprising:

a switch housing having an opening at the top;

stationary contacts within said housing connected to terminals outside said housing;

movable contact means in said housing operable to be moved into engagement with selected stationary contacts;

a switch operator comprising a double-throw rocker portion outside said housing adapted to be actuated from a center position in one or another direction by the user, a contact actuator portion coupled for double-throw rocking movement with said rocker portion and extending through said opening into said housing for moving said movable contact means, and pivoting means pivotally supporting both of said portions for double-throw rocking movement on said housing;

and selective lockout means including mounting means therefor rendering the same shiftable into one or another selective position for limiting rocking movement of said rocker portion to said one or said other direction as determined by the selective position of said lockout means.

2. The double-throw rocker switch with selective lockout means defined in claim 1, wherein said selective lockout means comprises:

a lockout member abutting said housing beneath said rocker portion;

means forming a part of said pivoting means for shifting said lockout member between two positions;

and stepped recesses on said rocker portion providing clearances for said lockout member to limit rocker movement of said rocker portion to one or the other direction as determined by the respective positions of said lockout member.

3. The double-throw rocker switch with selective lockout means defined in claim 1, wherein:

said contact actuator portion and said rocker portion are separate parts;

and complementary inter-engaging portions on said contact actuator part and said rocker part coupling the same rigidly to one another and held together by said pivoting means so that upon rocking movement of said rocker part said contact actuator part moves said movable contact means.

4. A rocker switch with selective lockout means comprising:

a switch housing having an opening at the top;

stationary contacts within said housing connected to terminals outside said housing;

movable contact means in said housing operable to be moved into engagement with selected stationary contacts;

a switch operator comprising a contact actuator portion extending through said opening into said housing for moving said movable contact means, a rocker portion outside said housing adapted to be actuated by the user, and pivoting means pivotally supporting the same on said housing;

selective lockout means for limiting rocking movement of said rocker portion to one or the other direction as determined by the selective position of said lockout means;

said contact actuator portion and said rocker portion are separate parts;

and complementary inter-engaging portions on said contact actuator part and said rocker part coupling the same securely to one another and held together by said pivoting means so that upon rocking movement of said rocker part said contact actuator part moves said movable contact means;

said pivoting means comprises;

a pair of pushbuttons having tubular stems with the ends of said stems abutting opposite sides of said lockout means;

said stems extending through holes in said housing and through holes in said contact actuator and said rocker parts to mount said contact actuator and said rocker parts on said housing while serving as a pivot therefor;

and an elongated securing member extending through said stems and said lockout means to clamp the latter there-between for lateral shifting thereby.

5. A rocker switch with selective lockout means comprising:

a switch housing having an opening at the top;

stationary contacts within said housing connected to terminals outside said housing;

movable contact means in said housing operable to be moved into engagement with selected stationary contacts;

a switch operator comprising a contact actuator portion extending through said opening into said housing for moving said movable contact means, a rocker portion outside said housing adapted to be actuated by the user, and pivoting means pivotally supporting the same on said housing;

and selective lockout means for limiting rocking movement of said rocker portion to one or the other direction as determined by the selective position of said lockout means comprising:

an inverted U-shaped lockout member secured at its center to the center of said pivoting means with the legs thereof resting on said housing and being laterally movable by said pivoting means between two selective positions;

and an abutment and groove on said rocker portion above each half of said lockout member in relatively reversed arrangement for limiting depression of said rocker portion to a different direction in each position of said lockout member.

6. A double-throw rocker switch with selective lockout means comprising:

a switch housing having an opening at the top and upstanding brackets on opposite sides of said opening with aligned holes therethrough;

a combined pivoting and lockout selecting shaft extending through said holes;

a switch operator pivoted on said shaft and having a contact actuator extending through said opening into said housing and a rocker button above said housing;

double-throw contacts in said housing operable by said contact actuator;

a lockout member secured at its middle to the mid-portion of said shaft and having opposite end portions extending in opposite directions beneath said rocker button and abutting said housing;

said combined pivoting and lockout selecting shaft being slidable in said holes in said frame and thus being effective to shift said lockout member relative to said rocker button;

and abutments and grooves in said rocker button limiting rocking thereof to a different direction in each position of said lockout member.

7. The double-throw rocker switch with selective lockout means defined in claim 6, wherein said combined pivoting and lockout selecting shaft comprises;

a pair of pushbottons, each having an enlarged head and a tubular stem with a hole extending all the way therethrough, and the ends of said stems abutting opposite sides of said lockout member;

an elongated securing member extending through both of said pushbuttons to clamp said lockout member rigidly therebetween;

and said stems being long enough to afford laterally sliding thereof with respect to said upstanding brackets of said housing thereby to afford reciprocal shifting of said lockout member between its selective lockout positions.

8. The double-throw rocker switch with selective lockout means defined in claim 6, wherein:

said contact actuator and said rocker button have interfitting portions for rigid coupling to one another when said shaft is passed therethrough while permitting separation thereof when assembling said lockout member therebetween.

9. The double-throw rocker switch with selective lockout means defined in claim 6, wherein said lockout member comprises:

a flat steel member clamped between portions of said combined pivoting and lockout selecting shaft and being relatively thin to limit the amount of shifting thereof required for selective lockout.

10. The double-throw rocker switch with selective lockout means defined in claim 9, wherein:

said rocker button comprises a detent spring biased against said lockout member and having a high point over which said lockout member must be snapped when shifting it from one position to another.

* * * * *